United States Patent [19]

Uesugi et al.

[11] Patent Number: 4,895,627

[45] Date of Patent: Jan. 23, 1990

[54] METHOD OF ELECTROLYTIC SURFACE TREATMENT OF ALUMINUM SUPPORTS FOR PLANOGRAPHIC PRINTING PLATES

[75] Inventors: Akio Uesugi; Tsutomu Kakei, both of Shizuoka, Japan

[73] Assignee: Fuji Photo Film Co., Ltd., Kanagawa, Japan

[21] Appl. No.: 305,597

[22] Filed: Feb. 3, 1989

[30] Foreign Application Priority Data

Feb. 5, 1988 [JP] Japan ..... 63-2402288

[51] Int. Cl.[4] ..... C25F 3/04

[52] U.S. Cl. ..... 204/129.75

[58] Field of Search ..... 204/129.75

[56] References Cited

FOREIGN PATENT DOCUMENTS 192300 11/1982 Japan .

*Primary Examiner*—T. M. Tufariello

*Attorney, Agent, or Firm*—Sughrue, Mion, Zinn, Macpeak & Seas

[57] ABSTRACT

A method of electrolytic surface treatment of aluminum supports for planographic printing plates, comprising the steps of: separating aluminum ions in an electrolyte for the surface treatment to the outside of a system using an ion-exchange membrane, and mixing the electrolyte after separation with a used electrolyte having high aluminum concentration, so that the aluminum ion concentration is adjusted to be constant in the electrolyte before use.

5 Claims, 1 Drawing Sheet

METHOD OF ELECTROLYTIC SURFACE TREATMENT OF ALUMINUM SUPPORTS FOR PLANOGRAPHIC PRINTING PLATES

BACKGROUND OF THE INVENTION

The present invention relates to a method of electrolytic surface treatment of aluminum supports for planographic printing plates, and more particularly to a method of keeping aluminum ion concentration constant in an electrolyte, the method being applicable to the electrolytes in an electrochemically roughening process, an anodic oxidation coating process, and a chemical etching process.

Various electrolytes have been conventionally used in the method for electrolytic surface treatment of aluminum supports for planographic printing plates. For example, nitric acid and hydrochloric acid are generally used in the electrochemically roughening process or sulfuric acid or the like is used in the anodizing process.

As a support used for a planographic printing plate, on the other hand, aluminum or an aluminum alloy is used. The surface shape or the like of the printing plates after treatment considerably vary according to the aluminum ion concentration in the foregoing electrolyte, and therefore it is important to keep the aluminum ion concentration constant in the electrolyte.

For example, in the case where graining is performed electrochemically using nitric acid, it is suitable not only to select the concentration of nitric acid to be 5 g/l–30 g/l, but also to select the aluminum ion concentration to be about 5 g/l–15 g/l so that the graining is most uniformly performed. Further, in the case where anodic oxidation is performed by using sulfuric acid, while it is suitable to select the concentration of sulfuric acid to be 100 g/l–300 g/l, the coating cannot be uniformly formed on the aluminum surface if the aluminum ion concentration exceeds 15 g/l.

In order to keep the aluminum ion concentration constant, there has been conventionally used a method in which an electrolyte in a system is discharged outside the system so as to keep the aluminum ion concentration constant in the electrolyte, or a method in which ion-exchange resin is used so as to absorb aluminum ions in an electrolyte to thereby keep the aluminum ion concentration constant in the electrolyte as disclosed in Japanese Patent Unexamined Publication No. 192300/82.

In the former method in which the electrolyte is discharged so as to control the aluminum ions outside the system, however, there has been a problem that the quantity of use of the electrolyte is excessively increased because the electrolyte is discharged together with aluminum ions, resulting in increased load for waste water treatment.

In the latter method in which aluminum ions are absorbed by ion-exchange resin so as to be discharged outside a system, on the other hand, there has been a problem that not only the rate of removal of the aluminum ions is low and therefore a large quantity of resin is required, but also it is necessary to exchange the resin about every three months, resulting in extreme increase in running cost.

SUMMARY OF THE INVENTION

An object of the present invention is to solve the foregoing problems in the prior art, and to provide a method of electrolytic surface treatment of aluminum supports for planographic printing plates in which the quantity of use of the electrolyte is decreased to thereby reduce the cost for the waste water treatment equipment and for the aluminum ion removal.

Another object of the present invention is to provide a method of electrolytic surface treatment of aluminum supports for planographic printing plates in which the surface treatment conditions are made stable, and the cost for the surface treatment is reduced.

In order to achieve the foregoing objects, the method of electrolytic surface treatment of aluminum supports for planographic printing plates, according to the present invention, is characterized in that aluminum ions in a electrolyte are separated to the outside of a system by using an ion-exchange membrane and the electrolyte after separation is mixed with a used electrolyte having high aluminum ion concentration so as to keep the aluminum ion concentration constant in the electrolyte before use.

Further, the present invention is particularly effectively utilized for a solution mainly containing nitric acid as an electrolyte, and treatment of a solution mainly containing sulfuric acid for use in the anodic oxidation coating process.

DETAILED DESCRIPTION OF THE INVENTION

Figure 1:
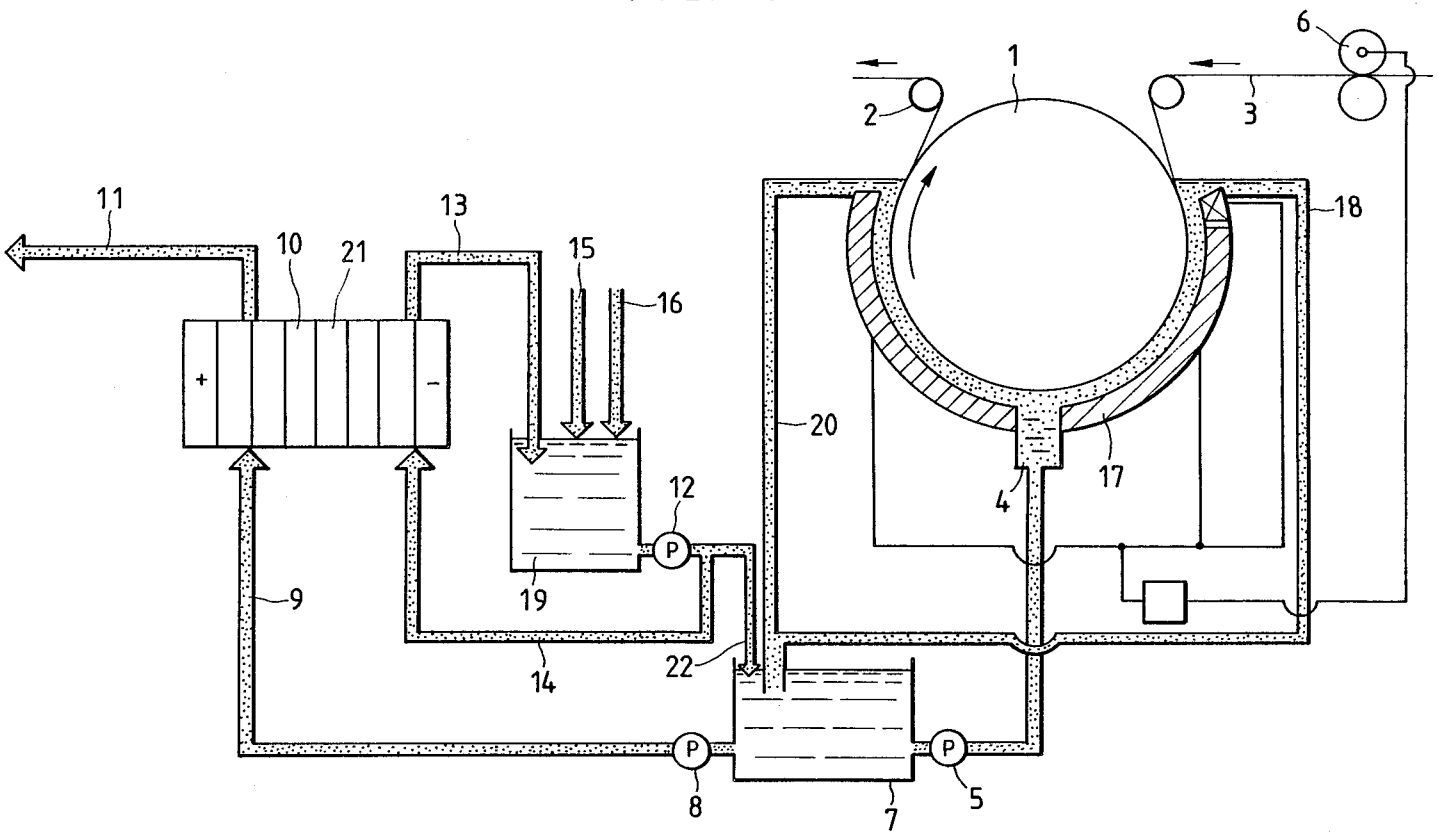
FIG. 1 is a schematic side view showing an example of the method of electrolytic surface treatment of aluminum supports for planographic printing plates according to the present invention.

The term "ion-exchange membrane" according to the present invention is defined as membrane having a characteristic that it can selectively transmit specific ions therethrough, but it is essentially different from ion-exchange resin in the point that the former does not require regeneration whereas the latter requires reproduction because the ion exchange is performed by absorption. Further, if necessary, it is possible to utilize electrodialysis using the ion-exchange membrane. That is, it is possible to discharge aluminum ions outside a system by use of such an ion-exchange membrane to regenerate an electrolyte.

In the method according to the present invention, "separation of aluminum ions in a electrolyte to the outside of a system" means that a electrolyte which has been used in a treatment process is discharged to the outside of a system at a place which is independent of the treatment process.

In the method according to the present invention, "mixing an electrolyte after separation with a used electrolyte having high aluminum ion concentration so as to keep the aluminum ion concentration constant in a electrolyte before use" means that the solution from which the aluminum ions have been separated to thereby reduce aluminum ion concentration therein is mixed with a supplementary solution and a used electrolyte to thereby adjust the aluminum ion concentration in an electrolyte before use for surface treatment.

EMBODIMENT

(Example - 1)

An example of the present invention will be described hereinafter with reference to the accompanying drawing. The present invention, however, is not limited only to this example.

FIG. 1 is a schematic side view for explaining the electrochemically roughening process according to the present invention. A rotary drum 1 supports an aluminum web 3 so as to keep a clearance between the web 3 and an electrode 17 constant, and nip rollers 6 are provided for supplying electricity to the web 3. In this configuration, a reaction is electrochemically caused to the aluminum web 3.

An electrolyte contained in a reservoir 7 for use for electrolysis is required to have constant aluminum ion concentration. The electrolyte is passed through a header 4 by a pump 5 to fill a space between the web 3 and the electrode 17, and then the electrolyte which has been used for the electrolytic treatment returns to the reservoir 7 through returning pipes 18 and 20.

In electrochemically roughening process, aluminum ions dissolved in the electrolyte in the treatment process are accumulated in the reservoir 7 if the aluminum ions are left as they are. Accordingly, the electrolyte is partially sent by a pump 8 through a pipe 9 outside a system into an electrodialysis apparatus 10 having an ion-exchange membrane 21 disposed therein. The aluminum ions of the electrolyte are selectively separated by the ion-exchange membrane 21 and then discharged outside the system through a drain pipe 11. In this case, the electrolyte is hardly mixed into the drain pipe 11 because of utilizing the ion-exchange membrane 21. The electrolyte collected after the separation of the aluminum ions is sent to a supplementary tank 19 through a regenerated pipe 13. Fresh water and a undiluted electrolyte are supplemented to the supplementary tank 19 through pipes 15 and 16 respectively. The regenerated electrolyte from which the aluminum ions have been removed as described above is mixed with the supplemented fresh water and undiluted electrolyte in the supplementary tank 19, and then the mixture is returned to the reservoir 7 by a pump 12 through a pipe 22, or the the electrodialysis apparatus 10 through a pipe 14. As a result, the aluminum ion concentration in the electrolyte within the reservoir 7 is reduced to be adjusted to be kept constant, and the electrolyte thus adjusted is supplied to the header 4 by the pump 5.

The quantity of use in the electrolyte per unit time in the foregoing system was obtained under the following conditions.

Aluminum width: 1000 mm
Treatment speed: 10 m/min
Electrolyte: nitric acid 20 g/l
aluminum ion 8 g/l;
Quantity of electricity: 600 cc/dm$^2$ Under the foregoing conditions, the quantity of use of nitric acid was 45 g/m$^2$, and production could be performed for 180 days without exchanging the ion-exchange membrane.

According to the present invention, it is preferable to select the aluminum ion concentration in an electrolyte so as to be not larger than 20 g/l.

(Comparative Example - 1)

The electrochemically roughening process was performed in a system in which ion-exchange resin was used in place of the foregoing ion-exchange membrane so as to discharge aluminum ions outside the system by absorption under the same conditions as those of the Example - 1. The quantity of use of nitric acid was 80 g/m$^2$ and it was necessary to exchange the ion-exchange resin every 30 days, so that an excessively high cost was required.

According to the present invention, by executing the method of electrolytic surface treatment of aluminum supports for planographic printing plates characterized in that aluminum ions in a electrolyte are separated to the outside of a system by using an ion-exchange membrane and the electrolyte after separation is mixed with a used electrolyte having high aluminum ion concentration so as to keep the aluminum ion concentration constant in the electrolyte before use, it has been made possible that the electrolytes (including solutions for the electrolyticaly roughening process, for the anodizing process, and for the chemical etching process) can be decreased, a waste water load is reduced, and a cost required for removing aluminum ions is decreased, whereby stabilization of the surface treatment conditions and reduction of the surface treatment cost can be realized.

What is claimed is:

1. A method of electrolytic surface treatment of aluminum supports for planographic printing plates, comprising the steps of:

separating aluminum ions in an electrolyte for the surface treatment to the outside of a system using an ion-exchange membrane; and mixing the electrolyte after separation with a used electrolyte having high aluminum concentration, thereby to keep the aluminum ion concentration constant in the electrolyte before use.

2. A method as claimed in claim 1, said method further comprising the step of:

after separating said aluminum ions to the outside of the system, mixing said electrolyte after separation with fresh water and undiluted electrolyte.

3. A method as claimed in claim 1, wherein said electrolyte mainly contains nitric acid.

4. A method as claimed in claim 1, wherein said electrolyte mainly contains sulfuric acid.

5. A method as claimed in claim 1, wherein the aluminum ion concentration in said electrolyte in adjusted to be not larger than 20 g/l.

* * * * *

UNITED STATES PATENT AND TRADEMARK OFFICE

CERTIFICATE OF CORRECTION

PATENT NO. : 4,895,627

DATED : JANUARY 23, 1990

INVENTOR(S) : A. UESUGI ET AL.

It is certified that error appears in the above-identified patent and that said Letters Patent is hereby corrected as shown below:

On the title page, item [30]:

Please change Foreign Application Priority Data from "63-2402288" to --63-024022--.

Signed and Sealed this

Sixteenth Day of April, 1991

*Attest:*

HARRY F. MANBECK, JR.

*Attesting Officer*

*Commissioner of Patents and Trademarks*